US009490568B2

(12) United States Patent
Luthy et al.

(10) Patent No.: US 9,490,568 B2
(45) Date of Patent: Nov. 8, 2016

(54) CONNECTOR WITH TPA

(71) Applicant: Molex, LLC, Lisle, IL (US)

(72) Inventors: John Luthy, Naperville, IL (US); Steven Sousek, Lincoln, NE (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/779,169

(22) PCT Filed: Mar. 31, 2014

(86) PCT No.: PCT/US2014/032345

§ 371 (c)(1),
(2) Date: Sep. 22, 2015

(87) PCT Pub. No.: WO2014/160995

PCT Pub. Date: Oct. 2, 2014

(65) Prior Publication Data

US 2016/0056563 A1 Feb. 25, 2016

Related U.S. Application Data

(60) Provisional application No. 61/806,593, filed on Mar. 29, 2013.

(51) Int. Cl.
*H01R 13/436* (2006.01)

(52) U.S. Cl.
CPC ..... *H01R 13/4364* (2013.01); *H01R 13/4361* (2013.01)

(58) Field of Classification Search
CPC ..... H01R 13/4364; H01R 13/4361
USPC ..... 439/751, 752, 752.5, 467
See application file for complete search history.

(56) References Cited

U.S. PATENT DOCUMENTS 4,946,398 A 8/1990 Takenouchi et al.
4,979,913 A * 12/1990 Aiello ..... H01R 13/422 439/596
5,354,218 A * 10/1994 Fry ..... H01R 13/422 439/595
5,407,363 A * 4/1995 Polgar ..... H01R 13/74 248/222.52
5,435,758 A * 7/1995 Sasai ..... H01R 13/4368 439/752
5,522,740 A 6/1996 Plocek et al.
5,595,509 A * 1/1997 Fry ..... H01R 13/4362 439/595
5,620,346 A 4/1997 Okumura
5,647,775 A * 7/1997 Polgar ..... H01R 13/4361 439/752
5,697,819 A * 12/1997 Hatagishi ..... H01R 13/501 439/752
5,713,756 A * 2/1998 Abe ..... H01R 13/501 439/404
5,779,506 A * 7/1998 Okabe ..... H01R 13/4361 439/752
5,800,216 A 9/1998 Okada
5,803,765 A * 9/1998 Peloza ..... H01R 12/7029 439/567
5,902,155 A * 5/1999 Polgar ..... H01R 13/518 439/353
6,024,605 A * 2/2000 Beck, Jr. ..... H01R 13/424 439/595
6,027,374 A * 2/2000 Nagai ..... H01R 13/4361 439/596
6,106,340 A * 8/2000 Myer ..... H01R 13/4367 439/595

(Continued)

FOREIGN PATENT DOCUMENTS

GB 2177855 A * 1/1987 ..... H01R 13/4223

*Primary Examiner* — Abdullah Riyami
*Assistant Examiner* — Nelson R Burgos-Guntin
(74) *Attorney, Agent, or Firm* — James A. O'Malley

(57) ABSTRACT

A connector is provided with a terminal position assurance (TPA) member that secures a terminal within a channel provided in a base. The TPA member can be secured to the base with a hinge that extends substantially a width of the base. The TPA member and the base can be formed as a one-piece molded part.

6 Claims, 10 Drawing Sheets

(56) References Cited

U.S. PATENT DOCUMENTS 6,116,954 A * 9/2000 Ries ..... H01R 13/506 439/423
6,183,313 B1 2/2001 Kashiyama
6,250,972 B1 * 6/2001 Shinchi ..... H01R 13/504 439/465
6,273,755 B1 * 8/2001 Yamamoto ..... H01R 13/4367 439/596
6,299,471 B1 * 10/2001 Hatagishi ..... H01R 4/2425 439/397
6,340,321 B2 * 1/2002 Sawayanagi ..... 439/877
6,416,700 B1 * 7/2002 Hatagishi ..... B29C 45/0017 264/242
6,443,767 B1 * 9/2002 Nagai ..... H01R 13/501 439/596
6,482,026 B2 * 11/2002 Morita ..... H01R 43/01 439/397
6,482,035 B2 * 11/2002 Okabe ..... H01R 4/2433 439/596
6,561,837 B1 * 5/2003 Ishida ..... H01R 4/2466 439/397
6,726,497 B2 4/2004 Nogawa et al.
6,881,102 B2 * 4/2005 Correll ..... H01R 13/428 439/752
6,887,104 B2 * 5/2005 Lee ..... H01R 43/0249 439/374
6,918,798 B2 * 7/2005 Patel ..... H01R 13/114 439/851
7,004,791 B2 * 2/2006 Mumper ..... H01R 43/18 439/595
7,004,796 B2 * 2/2006 Fukuda ..... H01R 43/20 439/752
7,540,749 B1 * 6/2009 Hall ..... H01R 13/516 439/135
8,043,104 B2 10/2011 Taketomi
9,070,999 B2 * 6/2015 Endo ..... H01R 13/506
9,083,108 B2 * 7/2015 Adachi ..... H01R 13/521
9,236,679 B2 * 1/2016 Beckstedt ..... H01R 4/36
2003/0139094 A1 * 7/2003 Venditti ..... H01R 13/506 439/596
2004/0235365 A1 * 11/2004 Fujita ..... H01R 13/516 439/752
2010/0041280 A1 * 2/2010 Morello ..... H01R 13/422 439/752
2016/0013575 A1 * 1/2016 Campbell ..... H01R 13/4362 439/752
2016/0056563 A1 * 2/2016 Luthy ..... H01R 13/4364 439/751

* cited by examiner

CONNECTOR WITH TPA

RELATED APPLICATIONS

This application claims priority to U.S. Ser. No. 61/806,593, filed Mar. 29, 2013, which is incorporated herein by reference in its entirety.

FIELD OF THE INVENTION

The present invention relates to field of connectors, more specifically to the field of connectors suitable for use on the end of a wire.

DESCRIPTION OF RELATED ART

Connectors with terminal position assurance (TPA) features are known. In general, a TPA feature helps ensure that a terminal is retained in a housing. Often such TPA features are provided by separate components that must be mated to a housing after the terminals are positioned in the housing. While hinged TPAs have also been provided, existing designs don't provide the desired set of features that ensure terminals are appropriately retained and positioned with the desired levels of reliability and ease of use. Thus certain individuals would appreciate further improvements in a connector with a TPA member.

BRIEF SUMMARY

A connector is provided that includes a housing with one more discrete insulated channels Each channel is configured to receive a terminal in a manner that prevents over insertion of the terminal into the channel, A terminal position assurance (TPA) member is hinged to the housing. The TPA member is configured so that it can be translated from an open position to a locked positioned and in the locked position the TPA member is configured to ensure the terminals are appropriately positioned and retained in their respective channels,

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1A:
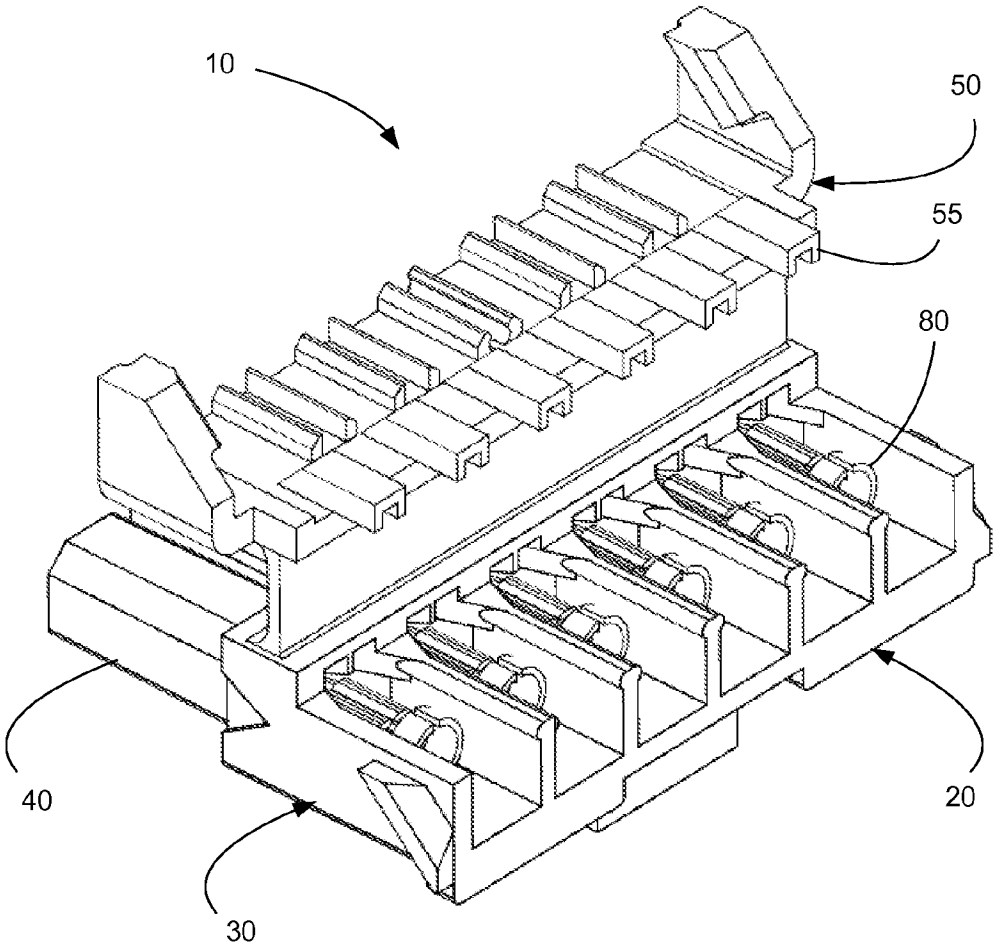
FIG. 1A illustrates a perspective view an embodiment of a connector with a TPA member that is hinged to a housing with the TPA in an open position.
Figure 1B:
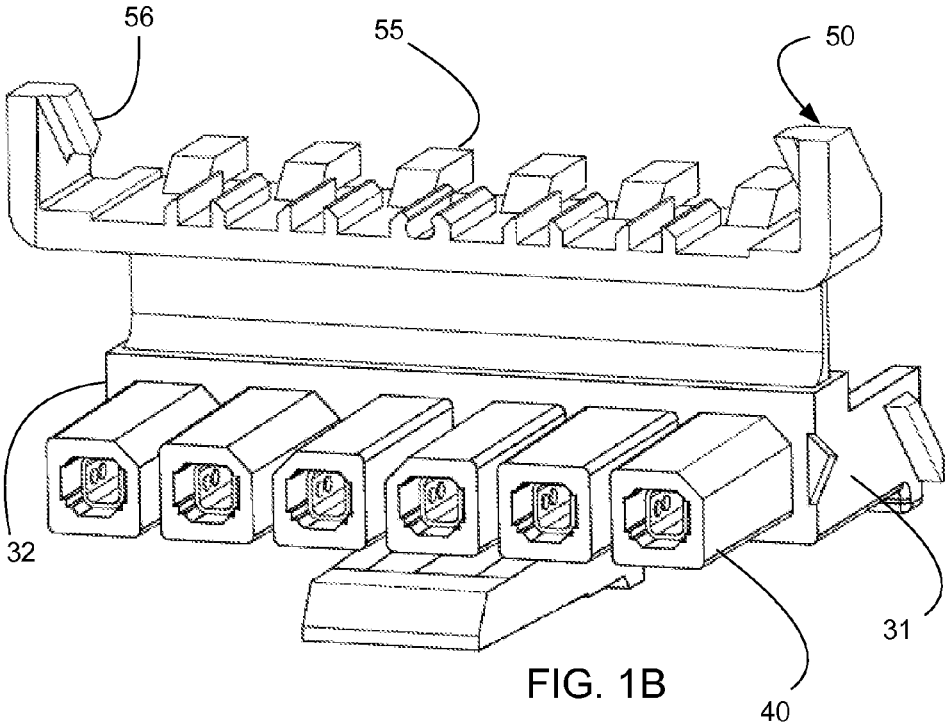
FIG. 1B illustrates another perspective view of the embodiment depicted in FIG. 1A.
Figure 2:
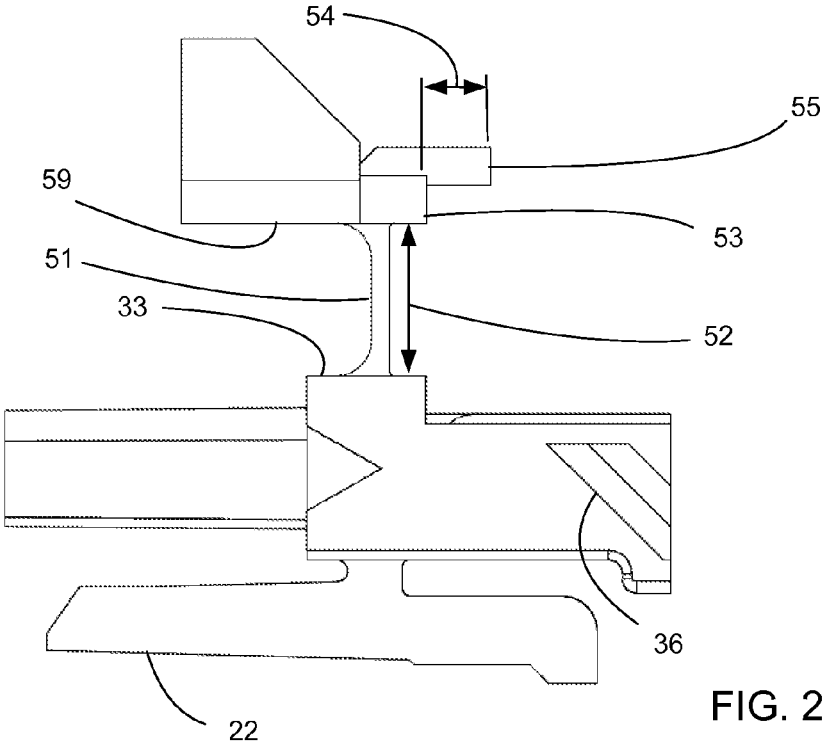
FIG. 2 illustrates an elevated side view of the embodiment depicted in FIG. 1A.
Figure 3:
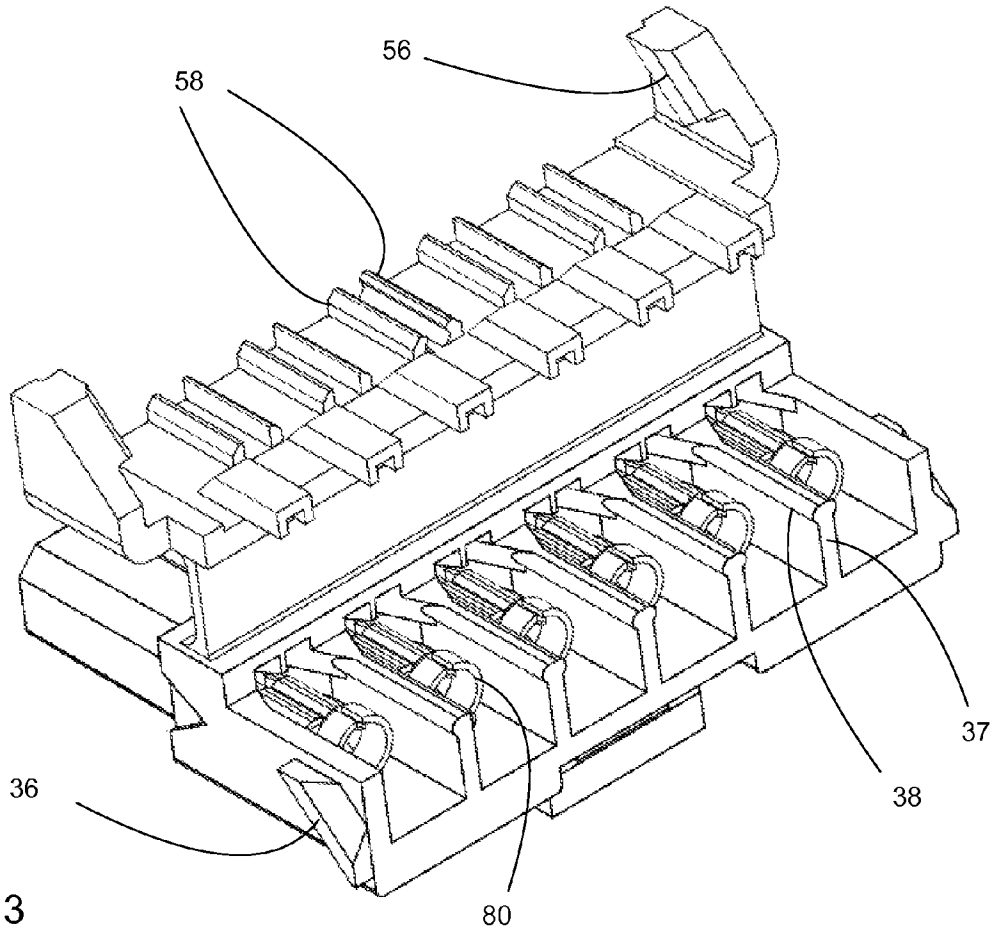
FIG. 3 illustrates an enlarged view of the embodiment depicted in FIG. 1A.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1A-10 illustrate features of an embodiment of a connector with a terminal position assurance (TPA) member hinged to the housing. As can be appreciated, the benefit of connecting the TPA directly to the housing is that a single molding operation can be used to provide the housing and the TPA member, thus potentially reducing costs. Thus depicted design can be a one-piece molded design. However, one issue with such designs is that it is more challenging to provide a hinged TPA member that doesn't just retain but also helps position terminals. Certain TPA members have attempted to provided such a feature but because of the complexity of the TPA member, those TPA member were either not attached to the housing (making the use of the TPA member more challenging as care was needed to ensure it was available when need) or they attached to the housing with just two hinges that were small to help ensure flexibility.

Applicants have determined that using a hinge that extends substantially a width of the base provides increased control over the position of the TPA member when it is translated into a locking position, helping to prevent misalignment during the translation of the TPA member. This in turn helps ensure the TPA member is properly positioned and has properly engaged each of the terminals, Such a design can also allow for substantial translation of the TPA member (for example, the TPA member can be rotated approximately 180 degrees).

Thus, as depicted a connector 10 includes a housing 20 with a base 30 that includes one or more channels 25. An optional and integral latch 22 can be provided as depicted. Each channel 25 extends to a nose 40 that extends from the base 30. A terminal 80 can be positioned in the channel 25. The nose 40 can be configured so that there is a gap (e.g., an air channel) between two adjacent noses 40 and the nose includes an interior surface 42 that defines a portion of the channel 25. The channel 25 has a first width 28*a* in the nose 40 and a second width 28*b* in the base 30. The base 30 has a first side 31, a second side 32 and a top surface 33 and includes angled retention flange 36 with a sloped surface 36*a* on both the first and second sides 31, 32, The base includes a wall 37 with an enlarged end 38.

Figure 4:
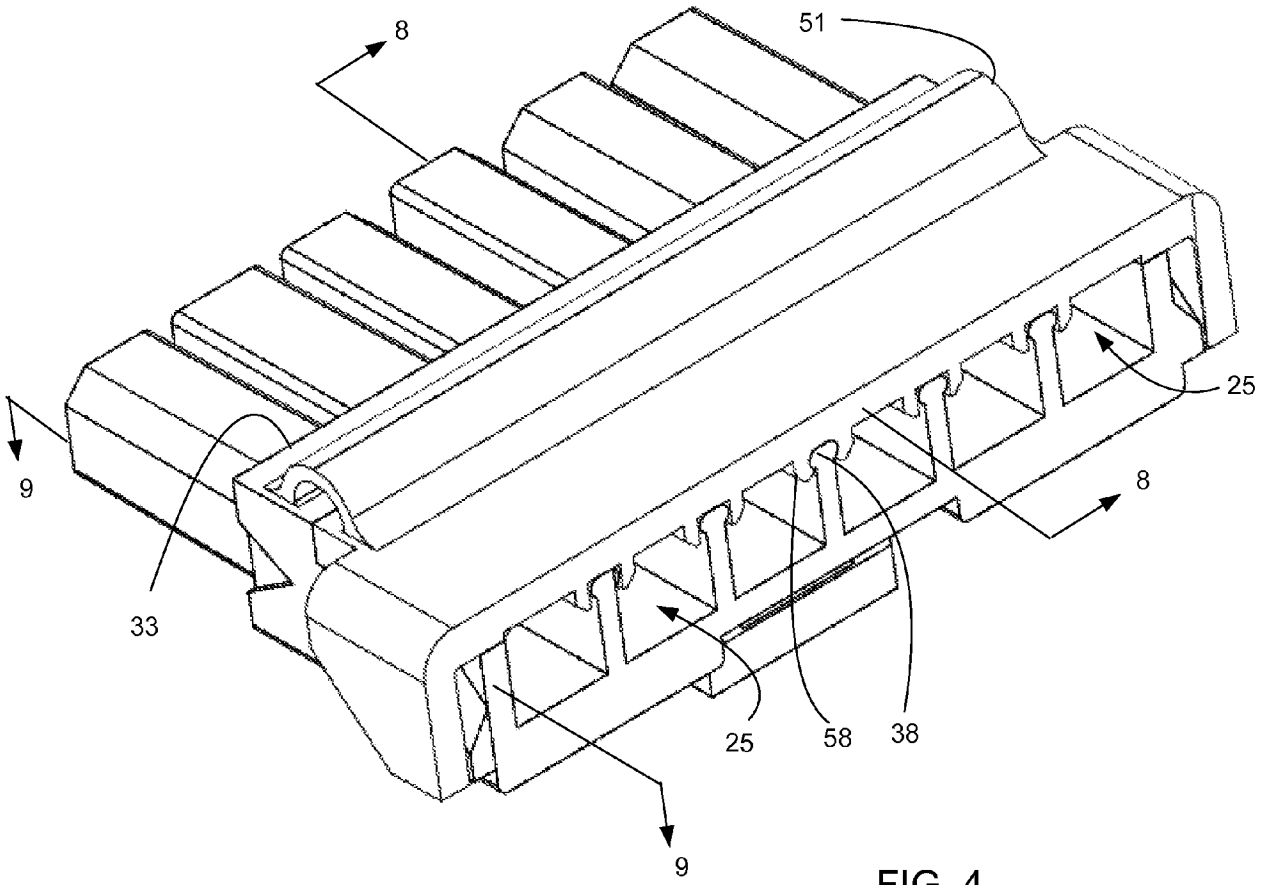
FIG. 4 illustrates a perspective view of an embodiment of a connector with a hinged TPA with the TPA in a closed position.
Figure 5:
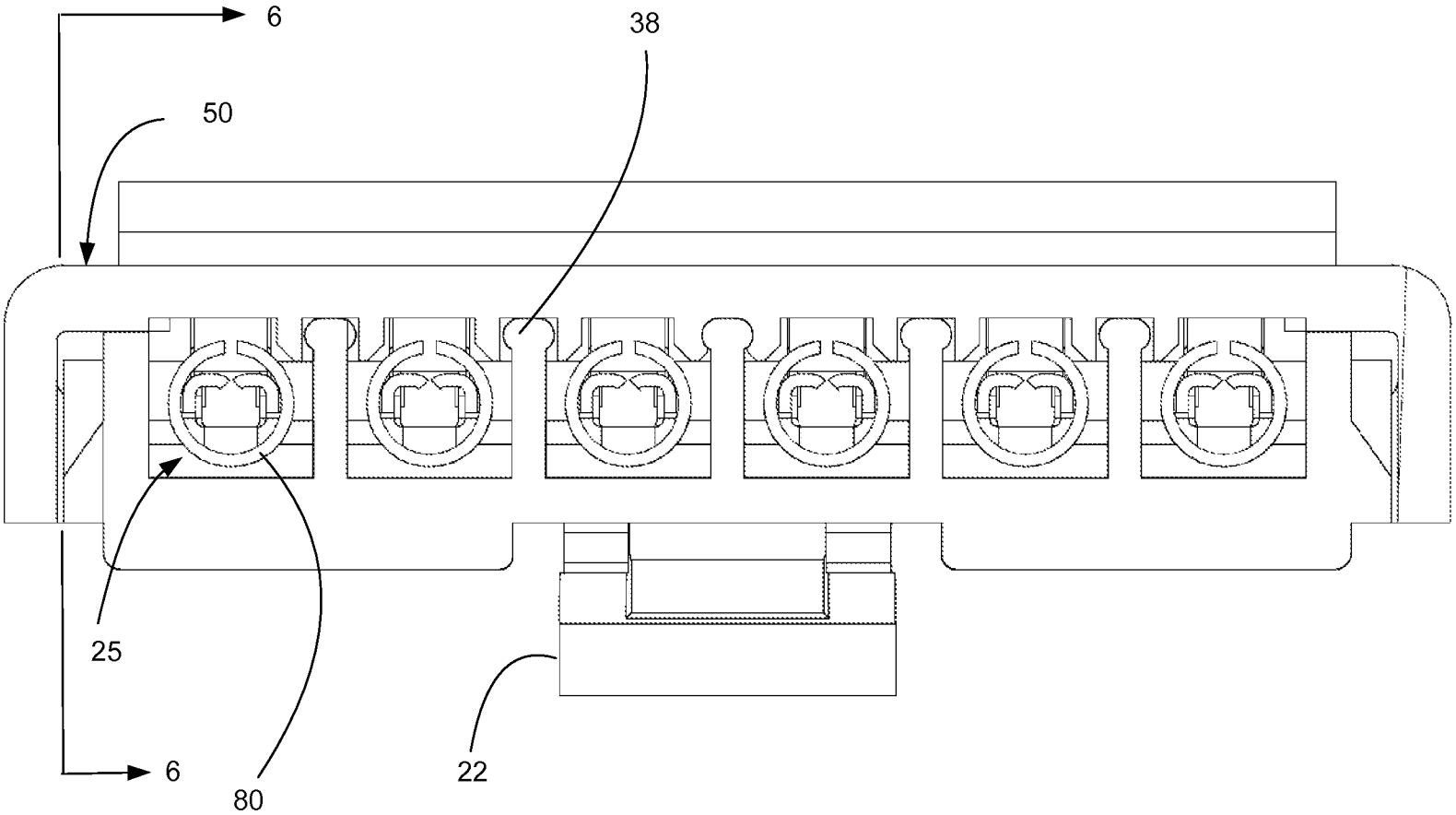
FIG. 5 illustrates an elevated front view of the embodiment depicted in FIG. 4.
Figure 6:
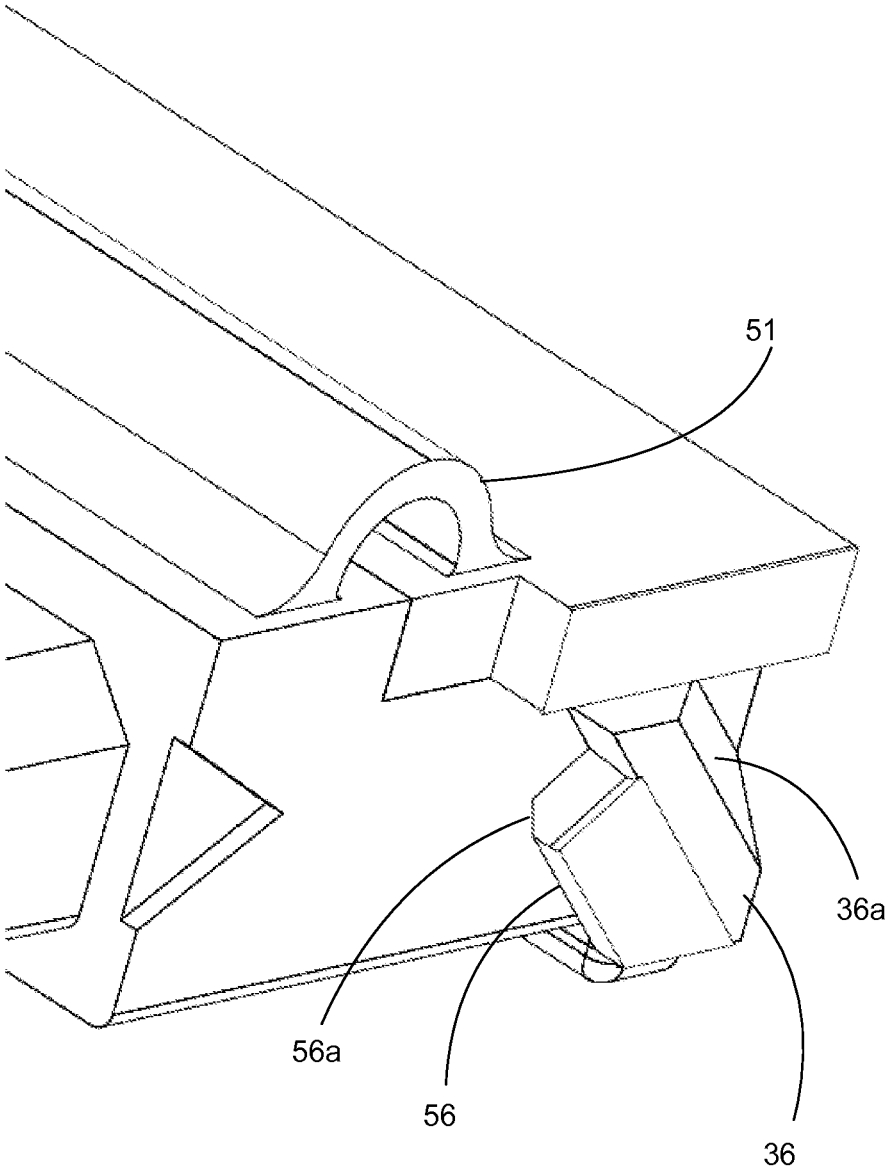
FIG. 6 illustrates a perspective view of a cross-section taken along line 6-6 in FIG. 5.
Figure 7A:
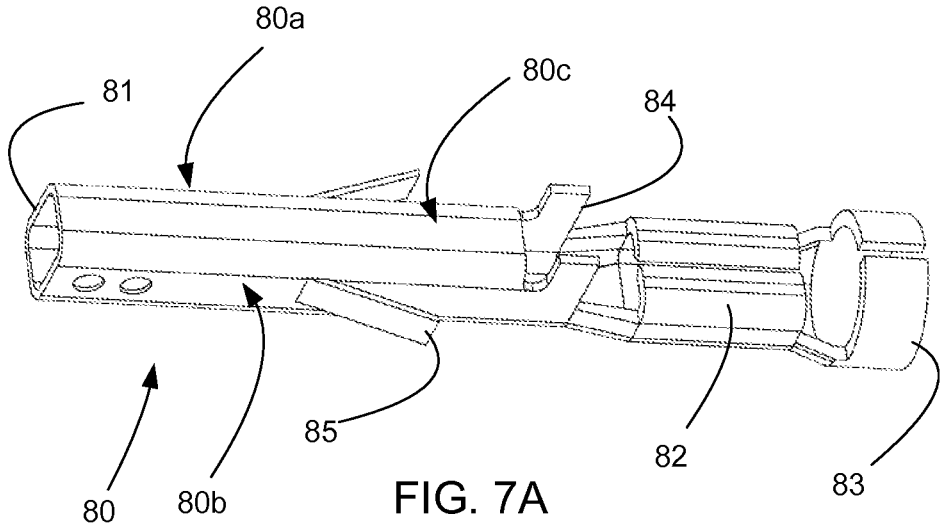
FIG. 7A illustrates a perspective view of an embodiment of a terminal.
Figure 7B:
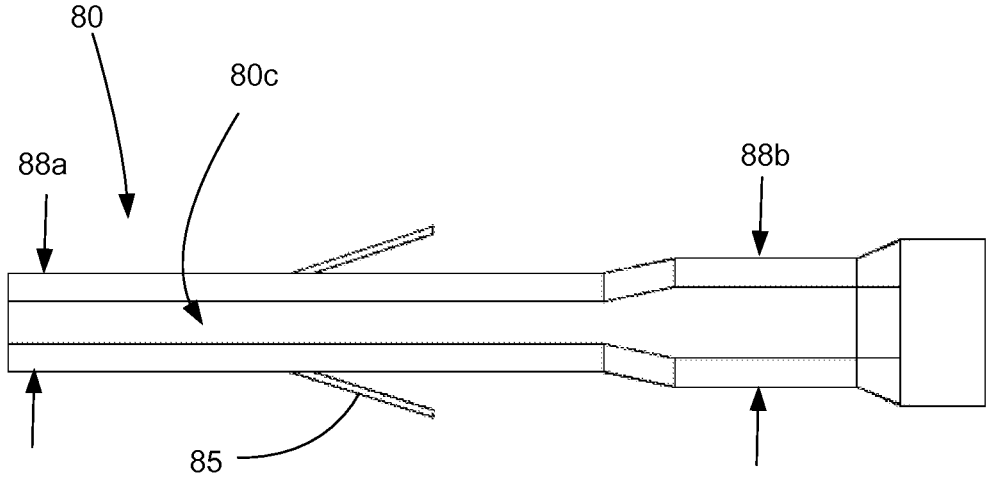
FIG. 7B illustrates a bottom view of the embodiment depicted in FIG. 7A.

A terminal position assurance (TPA) member 50 is supported by the base 30 and is connected to a top surface 33 of the base 30 via a hinge 51 that extends from a first side 31 of the base to a second side 32 of the base. The hinge 51 extends a distance 52 from the top surface 33 and provides sufficient space for the TPA member 50 to rotate more than 90 degrees, preferably about 180 degrees into a secured position. The TPA member 50 has a main wall 59 and includes a rear edge 53 that is configured to press against the base 30 and a pushing flange 55 extends from the main wall past the rear edge 53 a distance 54, the distance 54 being less than the distance 52. The pushing flange 55 can be u-shaped to provide additional support and to help securely hold a terminal in position. The TPA member 50 also include locking tab 56 with angled surface 56*a* and when the TPA member 50 is translated to the secured position the locking tab 56 engages angled retention flange 36 and the sloped surface 36*a* and the angled surface 56*a* aid in allowing the TPA member 50 to more easily snap into place. The TPA member 50 includes fingers 58 that are configured to engage enlarged end 38 when the TPA 50 is positioned in the secured position (as depicted in FIG. 4). It should be noted that the fingers 58 (which are provided in pairs) can be curved to more securely engage the enlarged ends 38 and while it has been determined to be beneficial in providing a more robust connector, such curvature is not required or may be used intermittently such that just one or some other number of fingers 58 securely engage the enlarged ends 38 (e.g., the fingers 58 can but do not need to snap over the enlarged ends 38).

As can be appreciated, once the TPA member 50 is in the secured position, the hinge 51 is curved. As noted above, the use of a wider hinge 51 was found to provide more of a benefit than expected as it helps provide a more controlled translation of the TPA member 50

The terminal 80 includes a first side 80*a*, a second side 80*b*, a top side 80*c* and a bottom side 80*d* and has a contact end 81, a crimp 82 and an insulator arm 83 to help provide strain relief it should be noted that the contact end 81 has a contact width 88*a* that is less than a crimp width 88*b* of crimp 82, In a typical configuration, the crimp 82 will securely engage a conductor and the insulator arm 83 will engage the insulation around the conductor. A projection 84 extends above the top side 80*c* and wings 85 are provided on opposing first and second sides 80*a*, 80*b*. It should be noted that while two projections 84 and two wings 85 are disclosed, the use of one of each could be used. The benefit of using both is that there is a more even distribution of force and improved retention of the terminal 80 in the housing 20.

Figure 8:
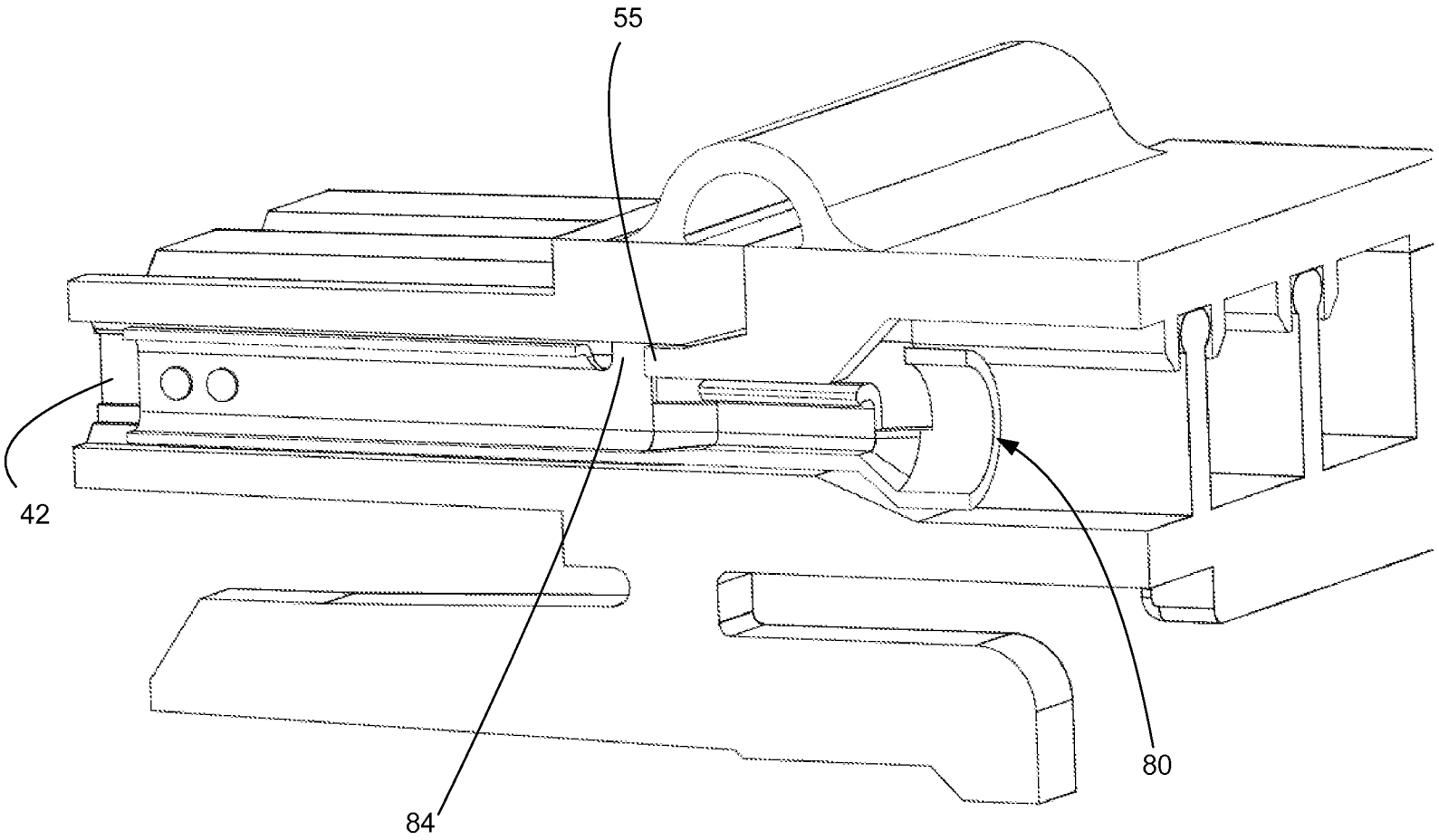
FIG. 8 illustrates a perspective view of a cross-section taken along line 8-8 in FIG. 4.
Figure 9:
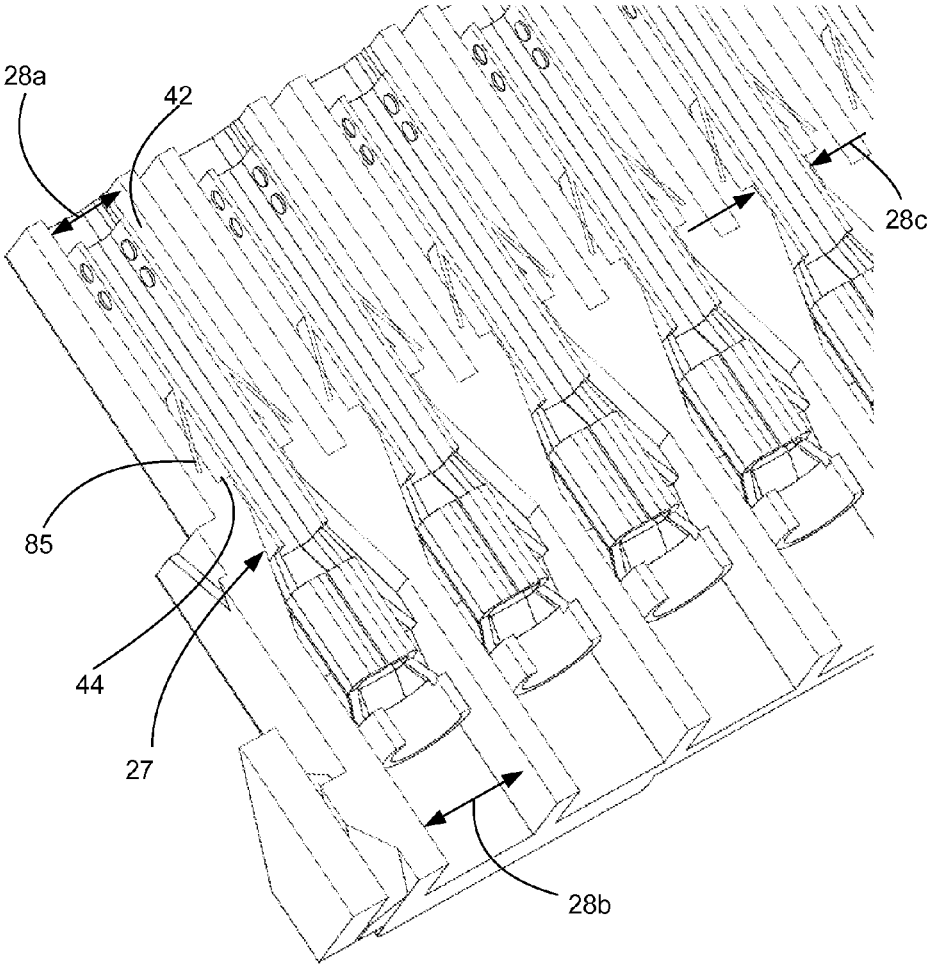
FIG. 9 illustrates a perspective view of a cross-section taken along line 9-9 in FIG. 4.

In operation, as can be appreciated from FIG. 8, the pushing flange 55 engages a projection 84 on the terminal 80 and helps position and secure the terminal 80 in the desired position in the channel 25. To provide for improved assembly process, a shoulder 44 in the interior surface 42 is provided and is configured to engage the wings 85. FIG. 9 illustrates the wings 85 overlapping the interior surface 42 but in practice, the wings 85 will just press against the interior surface 42 and will engage the shoulder 44 if the terminal 80 is attempted to be removed after the terminal is inserted into the channel 25. As can be appreciated, this helps ensure the terminal 80 doesn't accidentally fall out before the TPA member 50 is translated into the secure position. To help direct the terminal 80 into the desired orientation, a tapered portion 27 can be provided. The tapered portion 27, which necks down to a third width 28*c* that is less than the first width 28*a*, helps prevent the terminal 80 from being inserted sideways into the channel 25.

Figure 10:
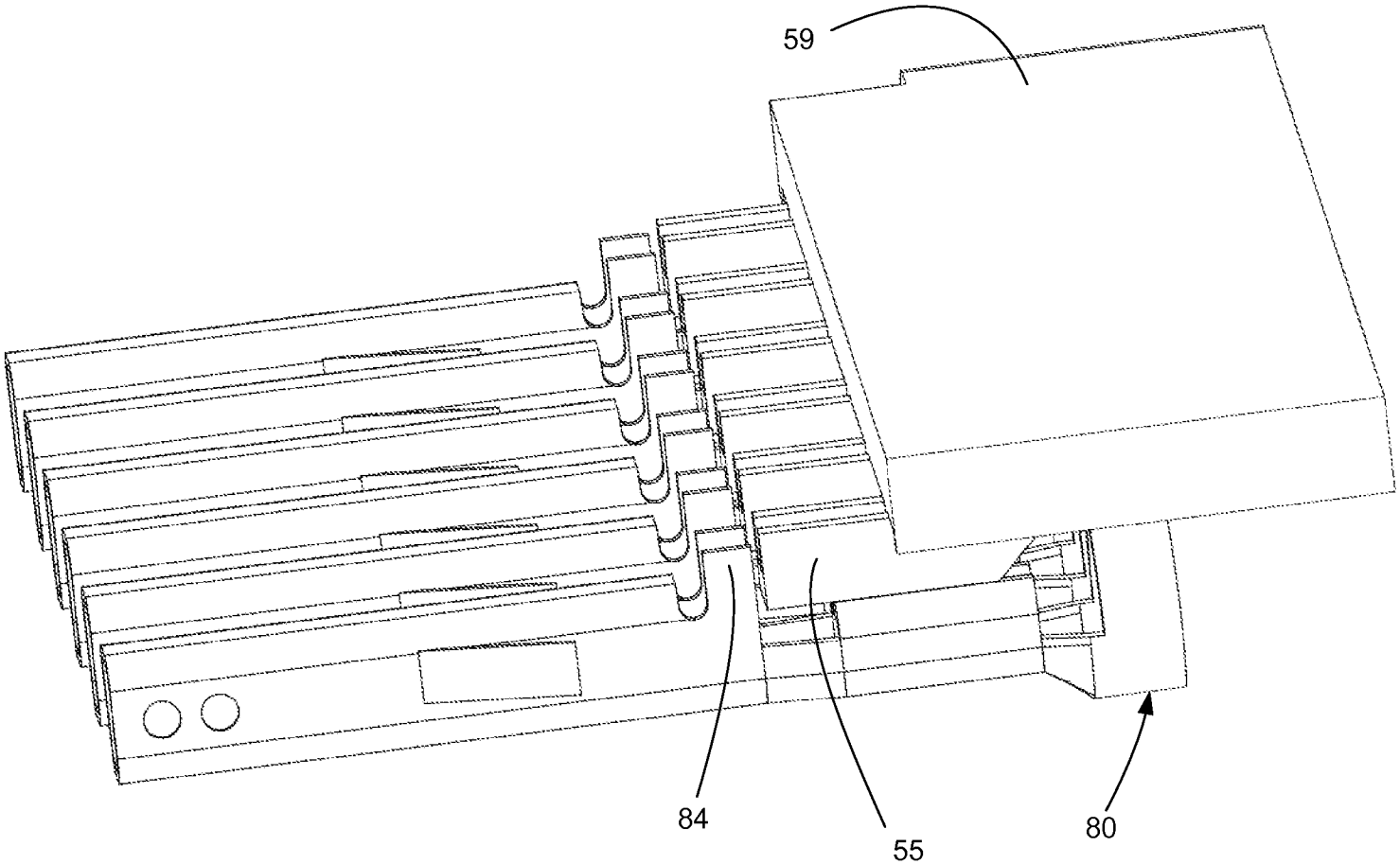
FIG. 10 illustrates a perspective view of a simplified embodiment with a terminal and a portion of a housing.

As can be appreciated from FIG. 10, the u-shape pushing flange 55 engages two projections 84 so as to provide a secure retention of the terminals 80. As noted above, this provides for additional reliability. Thus, the depicted connector provides for improved manufacturing due to offering a one-piece construction while providing a TPA that both helps position and also helps retain terminals in the connector.

The disclosure provided herein describes features in terms of preferred and exemplary embodiments thereof Numerous other embodiments, modifications and variations within the scope and spirit of the appended claims will occur to persons of ordinary skill in the art from a review of this disclosure.

We claim:

1. A connector, comprising:

a housing with a base and a nose, the base including a first side and a second side and having a top surface that extends between the first and second side, the nose extending from the base, the housing including a channel that extends within the base and the nose;

a terminal positioned in the channel, the terminal including a bottom side, a top side and two adjacent sides, the terminal having a contact end with a contact width and a crimp with a crimp width, the terminal further includes at least one projection extending above the top side; and a terminal position assurance (TPA) member extending from the top surface of the base, the TPA member having a hinge that substantially extends from the first side to the second side of the base, the hinge extending from the top surface and connecting the TPA member to the top surface, the TPA member including a rear edge that is configured to rotate approximately 180 degrees so as to press against the base, the TPA member including a pushing flange that extends past the rear edge, the pushing flange configured to be inserted into the channel, the pushing flange engaging the projection so as to prevent the terminal from translating past the TPA member.

2. The connector of claim 1, wherein the hinge extends a first distance from the top surface, wherein the pushing flange extends past the rear edge a second distance, and wherein the first distance is greater than the second distance.

3. The connector of claim 2, wherein a plurality of terminals are provided, and wherein the housing includes a plurality of noses extending from the base and a plurality of channels that extend within the base and the noses, each nose being spaced apart from an adjacent nose so that there is an air gap between two adjacent noses, and wherein each nose has a single channel extending therein and each channel has a single terminal positioned therein.

4. The connector of claim 1, wherein the channel has a first width in the nose and a second width in the base, the second width being greater than the first width and the first width being greater than the contact width.

5. The connector of claim 4, further comprising a tapered portion in the channel, the tapered portion providing a transition from the second width to a third width that is less than the first width.

6. The connector of claim 5, wherein the terminal includes at least one wing and the channel includes a shoulder, the wing configured to engage the shoulder and prevent removal of the terminal once the terminal is inserted into the channel.

* * * * *